United States Patent [19]

Schumacher

[11] 3,955,375

[45] May 11, 1976

[54] COMBINATION LIQUID TRAPPING SUCTION ACCUMULATOR AND EVAPORATOR PRESSURE REGULATOR DEVICE INCLUDING A CAPILLARY CARTRIDGE AND HEAT EXCHANGER

[75] Inventor: Ernest W. Schumacher, Portsmouth, Va.

[73] Assignee: Virginia Chemicals Inc., Portsmouth, Va.

[22] Filed: Oct. 30, 1974

[21] Appl. No.: 519,307

Related U.S. Application Data

[62] Division of Ser. No. 388,281, Aug. 14, 1974, Pat. No. 3,858,407.

[52] U.S. Cl. ..... 62/217; 62/503

[51] Int. Cl.[2] ..... F25B 43/00; F25B 49/00

[58] Field of Search ..... 62/217, 503, 474, 196, 62/471, 222

[56] References Cited

UNITED STATES PATENTS

| | | | |
|---|---|---|---|
| 2,859,596 | 11/1958 | Evans | 62/503 X |
| 3,246,482 | 4/1966 | Harnish | 62/513 X |
| 3,525,234 | 8/1970 | Widdowson | 62/217 |
| 3,796,064 | 3/1974 | Ladusaw | 62/503 |
| 3,798,921 | 3/1974 | Scherer et al. | 62/503 X |

*Primary Examiner*—William E. Wayner

[57] ABSTRACT

A combination liquid trapping suction accumulator and evaporator pressure regulator device used intermediate the compressor and evaporator in a vapor-compression refrigeration system as a protective device for the compressor. The device is characterized by the positioning of the evaporator pressure regulator chamber intermediate the inlet and outlet ports of the accumulator housing. Thus, evaporator pressure regulation is accomplished simultaneously with liquid accumulation in a compact and readily serviceable, unitary housing.

3 Claims, 2 Drawing Figures

COMBINATION LIQUID TRAPPING SUCTION ACCUMULATOR AND EVAPORATOR PRESSURE REGULATOR DEVICE INCLUDING A CAPILLARY CARTRIDGE AND HEAT EXCHANGER

CROSS REFERENCE TO RELATED APPLICATION

A modification of the assignee's earlier filed application entitled LIQUID TRAPPING SUCTION ACCUMULATOR (Ser. No. 359,569) now abandoned, filed May 11, 1973. This application is a division of U.S. Ser. No. 388,281 now U.S. Pat. No. 3,858,407.

The present application is characterized in its combining of an evaporator pressure regulator device with a liquid trapping suction accumulator.

BACKGROUND OF THE INVENTION

Automobile air conditioning and refrigeration systems are conventionally subject to a high rate of failure, due principally to liquid entering the compressor. These failures frequently occur after a short shut-down of the automobile which defeats the thermostatic expansion valve, permitting liquid to migrate from the condenser into the evaporator. As the automobile air conditioning system is restarted, the liquid goes to the compressor with damaging results. The automobile system is characterized by the extraordinarily wide range of flow rates, a principal aim being to return the oil through the eductor, regardless of flow rate.

Liquid suction accumulators are widely employed to solve the problem of liquid entering the compressor. However, there is no prior art showing a combination of these elements within a single working system and utilizing pressure drops obtained, for example, through the evaporator pressure regulator as an assistance in the education of oil through the system.

SUMMARY OF THE INVENTION

According to the present invention, an evaporator pressure regulator (EPR) is interposed between the inlet and outlet ports of an accumulator chamber. The evaporator pressure regulator (EPR) may include an evaporator pressure regulator device of the bellows or other type, regulating vaporous flow from inlet to outlet, according to pressure within the system. The pressure drop obtained through the evaporator pressure regulator device is utilized in drawing oil through the eductor tube.

Modification of the invention includes positioning of an expansion valve within the accumulator housing, use of a combined thermostatic expansion valve and a filter drier adjacent to the accumulator chamber, positioning of both the expansion valve and a desiccant within the accumulator chamber, utilization of a fixed orifice or capillary feeding device intermediate the filter drier and the evaporator in the system, positioning of the evaporator pressure regulator device perpendicularly with respect to the top of the accumulator chamber and providing the evaporator pressure regulator chamber with quick disconnects, fitting and sealing fixtures.

According to the particularly claimed species of FIG. 2 herein the vertically extending accumulator chamber includes a pressure responsive evaporator pressure regulator vertically positioned in the evaporator pressure chamber proximate the outlet port. A vertically extending eductor tube extends independently from the bottom of said accumulator chamber into the evaporator pressure chamber regulator chamber to efficiently allow only the pressure drop across the EPR to be effective for positive oil return. A further advantageous feature of the construction of FIG. 2 is the provision of a heat exchanger coil within and proximate the bottom of said accumulator, this coil extending intermediate the inlet of a capillary cartridge assembly, externally supported upon the bottom of the accumulator, and the capillary mounted therein.

Figure 1:
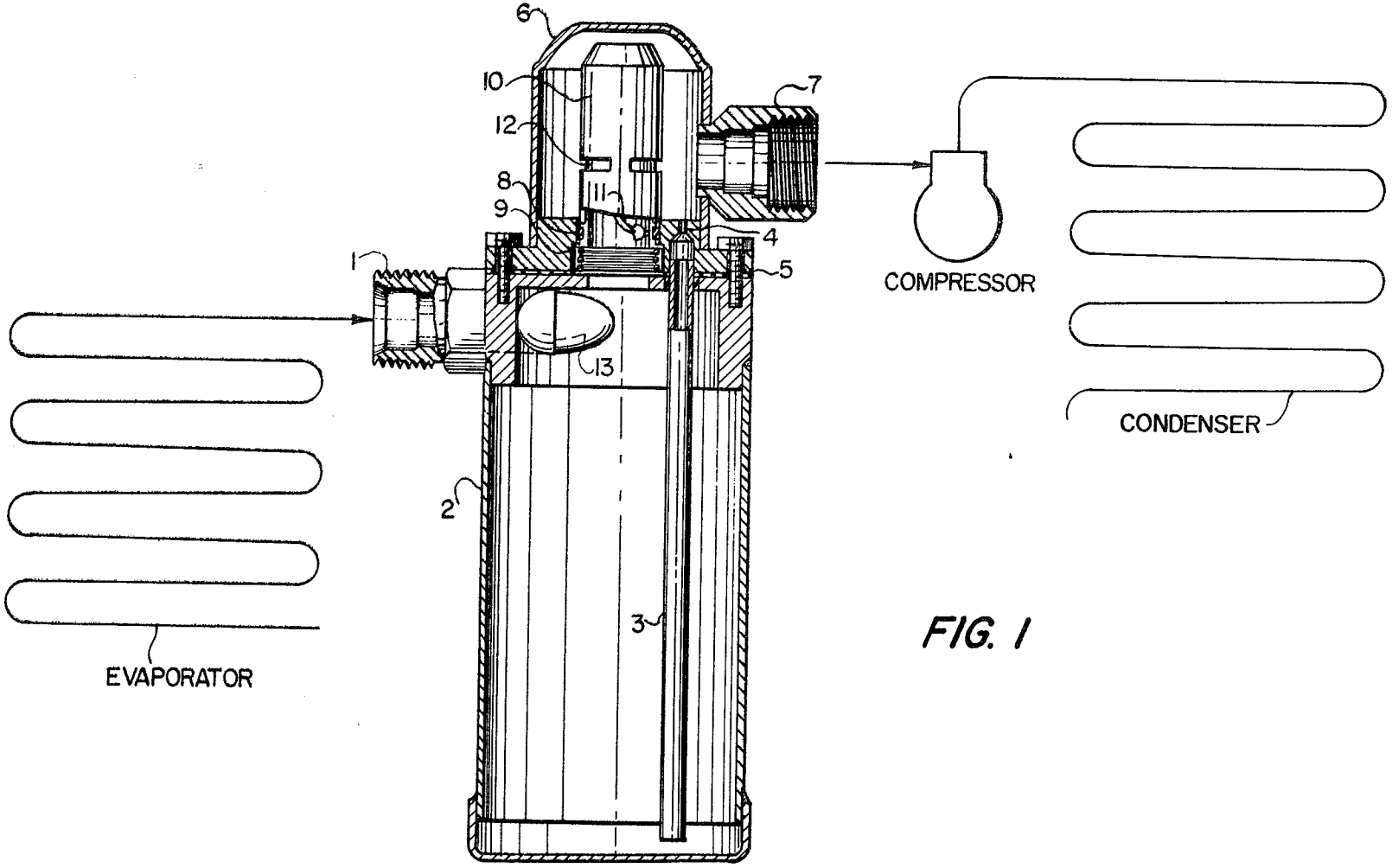
FIG. 1 is a schematic view, partially in vertical section, showing a combined evaporator pressure regulator chamber and accumulator, according to the present invention.

DESCRIPTION OF THE PREFERRED EMBODIMENTS:

The primary function of a suction accumulator is to prevent liquid refrigerant from entering the compressor. It must also provide positive oil return at all system flow rates. Conventional accumulators are designed to provide adequate pressure drop for positive oil return at minimum system flow rates. However, when systems experience high maximum to minimum flow rate ratios, accumulator pressure drops at high load conditions become excessive. The combining of the EPR and accumulator can solve this problem. The EPR represents a finite pressure drop in the suction line at all operating conditions. In fact, the pressure drop across the EPR is generally greatest at low loads. Integration of the accumulator and the EPR allows the pressure drop across the EPR to be utilized for positive oil return. This arrangement allows the accumulator to be designed for minimum pressure drop while still performing its liquid trapping function. In FIG. 1 the refrigerant-oil mixture is shown entering the accumulator vessel 2 at inlet connection 1. Oil is returned through eductor tube 3 which is connected to outlet orifice 4. Orifice 4 is arranged to bypass the EPR 10, hence taking advantage of its pressure differential for oil return. The oil is mixed with the refrigerant vapors exiting the EPR 10 in chamber 6 and returned to the compressor through outlet connection 7. O-ring 8 provides a positive seal between the inlet and outlet of EPR 10 and compression spring 9 provides positive retention of the EPR 10 in its socket. EPR may be of the bellows-type containing an inert gas such as nitrogen which is charged through nipple 11. Pressure changes move the bellows which moves a spool or slide across peripheral slots 12, so as to regulate vaporous flow. A tangential entry device 13 may be positioned adjacent inlet connection 1, to provide consistent liquid and vapor separation.

Figure 2:
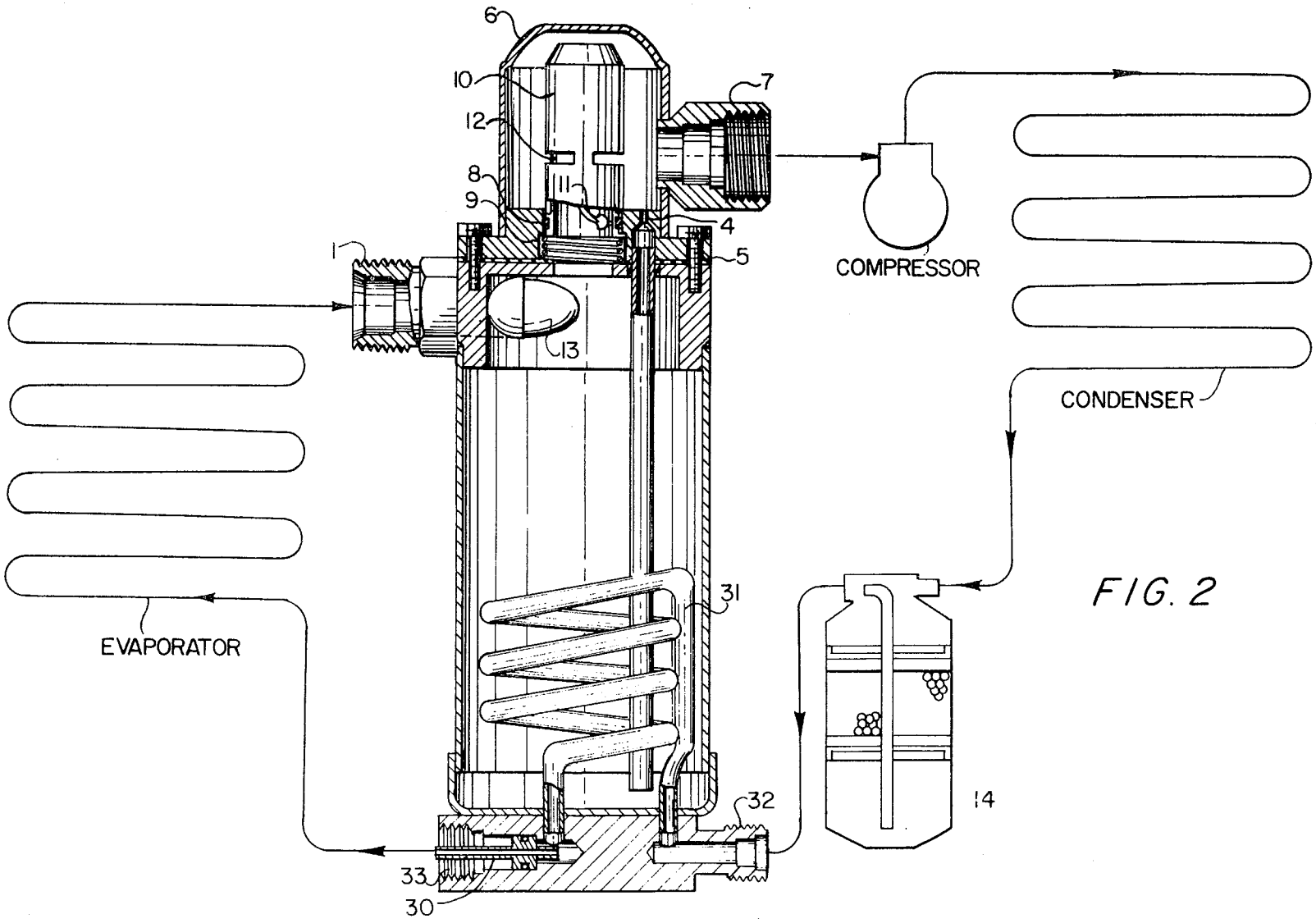
FIG. 2 is a schematic view, partially in section, showing a further modification wherein a capillary tube device is mounted in the bottom of the accumulator chamber and includes a heat exchanger preceeding the inlet ports of the capillary device.

FIG. 2 schematically shows the combination EPR-accumulator (described in FIG. 1) in a complete system, including a filter-drier or receiver-drier 14 with a desiccant mounted therein. However, the receiver-drier is no longer fully required, since the accumulator can perform the liquid storage function for which the receiver was previously required. Two additional advantages are also obtained with this arrangement. First, loss of liquid subcooling, which normally occurs in a receiver, may be reduced. The much smaller filter-drier 14 is always liquid full, which enables it to better retain any subcooling obtained in the condenser. In fact, filter-drier 14 may provide additional subcooling, if it can be located in an ambient somewhat below condensing temperature. The second advantage is that evaporator performance can be improved, since proper control arrangement will allow "over-feeding" of the evaporator without risk of liquid entering the compressor.

Since the suction accumulator 2 is able to positively manage liquid on the low side, it now becomes feasible as illustrated in FIG. 2, to consider the elimination of the costly and complex expansion valve. The capillary 30 has the inherent ability to maintain a liquid seal at its inlet with changing system conditions.

Proper cap tube selection would allow the evaporator to be completely fed during maximum load conditions thereby improving evaporator performance.

FIG. 2 illustrates a system wherein the capillary 30 has been located at the bottom of the accumulator 2. A liquid to suction heat exchanger 21 has also been positioned intermediate entry port 32 and exit port 33 to improve the system's thermodynamic performance. With this arrangement, the evaporator may be fully used since the requirement of superheat at the evaporator exit no longer exists.

The functions of the filter-drier may also be located within accumulator 2 as described, above.

I claim:

1. A liquid trapping suction accumulator adapted for insertion in a vapor-compression refrigeration system between the evaporator and compressor comprising:

A. an accumulator chamber defined by a casing vertically extending and having a top and a bottom;

B. inlet and outlet ports opening into the top of said chamber and respectively adapted for operative connection to said evaporator and said compressor;

C. an evaporator pressure chamber interposed between said inlet and outlet ports in communication with said accumulator chamber said chamber including:

i. a pressure responsive evaporator pressure regulator device, vertically positioned in said evaporator pressure chamber proximate said outlet port so as to gauge admission of vapor from said accumulator chamber into said evaporator pressure regulator chamber and through said outlet;

D. an eductor tube vertically extending independently from the bottom of said accumulator chamber into said evaporator pressure regulator chamber;

E. a capillary cartridge assembly externally supported upon the bottom of said accumulator chamber, said cartridge assembly having an entrance port communicating with a filter drier positioned intermediate said capillary cartridge inlet and said condenser in said system; and, F. a heat exchanger coil within and proximate the bottom of said accumulator, said coil extending intermediate said capillary cartridge inlet and a capillary within said assembly, said capillary in turn communicating with an outlet extending to said evaporator.

2. The liquid trapping suction accumulator of claim 1 including a tangential entry device positioned in said accumulator chamber adjacent said inlet port, as an assistance in separation of liquid and vapor.

3. The liquid trapping suction accumulator of claim 1 wherein said evaporator pressure regulator includes a pressure sensitive bellows valving device.

* * * * *